US009954290B2

(12) United States Patent
Sudou et al.

(10) Patent No.: US 9,954,290 B2
(45) Date of Patent: Apr. 24, 2018

(54) TERMINAL FIXING JIG AND METHOD FOR MANUFACTURING ELECTRIC WIRE WITH HEAT-SHRINKABLE TUBE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroshi Sudou, Mie (JP); Hayato Aoi, Mie (JP)

(73) Assignees: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/557,625

(22) PCT Filed: Mar. 3, 2016

(86) PCT No.: PCT/JP2016/056534

§ 371 (c)(1),
(2) Date: Sep. 12, 2017

(87) PCT Pub. No.: WO2016/152433

PCT Pub. Date: Sep. 29, 2016

(65) Prior Publication Data

US 2018/0069329 A1 Mar. 8, 2018

(30) Foreign Application Priority Data

Mar. 20, 2015 (JP) ..... 2015-057853

(51) Int. Cl.
*H01R 4/72* (2006.01)
*H01R 4/24* (2018.01)
(Continued)

(52) U.S. Cl.
CPC ..... *H01R 4/72* (2013.01); *H01B 7/0009* (2013.01); *H01R 4/2425* (2013.01);
(Continued)

(58) Field of Classification Search
USPC ..... 147/72 A
See application file for complete search history.

(56) References Cited

U.S. PATENT DOCUMENTS 4,420,020 A * 12/1983 McGeary ..... H01R 43/28 140/147
4,714,438 A * 12/1987 Williams ..... H02G 15/103 174/73.1
(Continued)

FOREIGN PATENT DOCUMENTS

JP S62175666 U 11/1987
JP H10289745 A 10/1998
(Continued)

OTHER PUBLICATIONS

International Search Report for application PCT/JP2016/056534 dated May 31, 2016; 5 pages.

*Primary Examiner* — William H Mayo, III
*Assistant Examiner* — Krystal Robinson
(74) *Attorney, Agent, or Firm* — Reising Ethington, P.C.

(57) ABSTRACT

A terminal fixing jig includes a terminal insertion support portion that is open outward, the terminal insertion recess portion being formed in a shape that allows a plate-shaped counterpart connecting portion to be inserted thereinto through the opening, and a terminal fitting fixing portion that includes a fitting portion being able to fit in a hole formed in the counterpart connecting portion and a fitting portion support portion for supporting the fitting portion to enable advance and retraction of the fitting portion while biasing the fitting portion in an advancing direction, wherein the terminal fitting fixing portion is fixed to the terminal inser-
(Continued)

tion support portion such that it can come into contact with the counterpart connecting portion to be advanced or retracted, and the fitting portion can be fitted into the hole of the counterpart connecting portion with the counterpart connecting portion inserted to a rear side of the terminal insertion recess portion.

8 Claims, 6 Drawing Sheets

(51) Int. Cl.

| | |
|---|---|
| ***H01R 13/52*** | (2006.01) |
| ***H01R 43/20*** | (2006.01) |
| ***H01R 43/048*** | (2006.01) |
| ***H01B 7/00*** | (2006.01) |
| ***H01R 43/00*** | (2006.01) |

(52) U.S. Cl.
CPC ..... *H01R 13/5216* (2013.01); *H01R 43/005* (2013.01); *H01R 43/048* (2013.01); *H01R 43/20* (2013.01)

(56) References Cited

U.S. PATENT DOCUMENTS 5,630,273 A * 5/1997 Kobayashi ..... H01R 43/20 269/903
5,749,756 A * 5/1998 Vockroth ..... H01R 4/203 174/84 C
6,005,471 A * 12/1999 Higashikata ..... H01H 37/5418 337/347
7,854,620 B2 * 12/2010 Hughes ..... H01R 13/035 439/181
8,771,015 B2 * 7/2014 Inoue ..... H01R 4/70 439/604
8,866,014 B2 * 10/2014 Wentzel ..... H01R 4/646 174/93
2009/0126993 A1 * 5/2009 Nishimura ..... H01B 3/28 174/72 A
2012/0199391 A1 * 8/2012 Inoue ..... H01B 7/2806 174/72 A
2013/0292173 A1 * 11/2013 Inoue ..... H01R 4/185 174/74 R
2014/0230996 A1 * 8/2014 Saito ..... H01R 4/72 156/86
2015/0111442 A1 * 4/2015 Miyamoto ..... H01R 4/62 439/874
2017/0338640 A1 * 11/2017 Sudou ..... H01R 4/72

FOREIGN PATENT DOCUMENTS

JP 2002033026 A 1/2002
JP 2006261065 A 9/2006
JP 2012104234 A 5/2012
JP 2013114936 A 6/2013

* cited by examiner

*Figure 1*
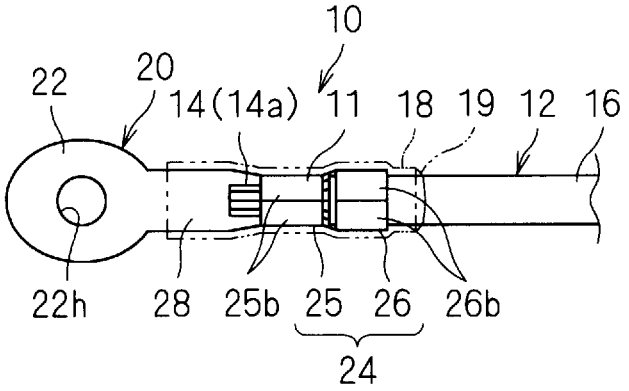
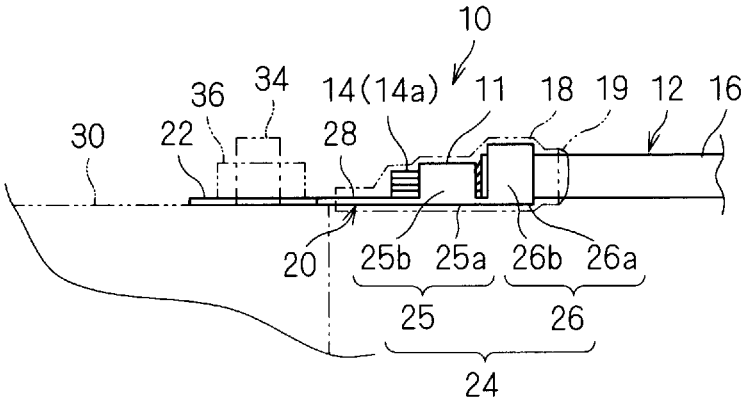
*Figure 2*

*Figure 3*
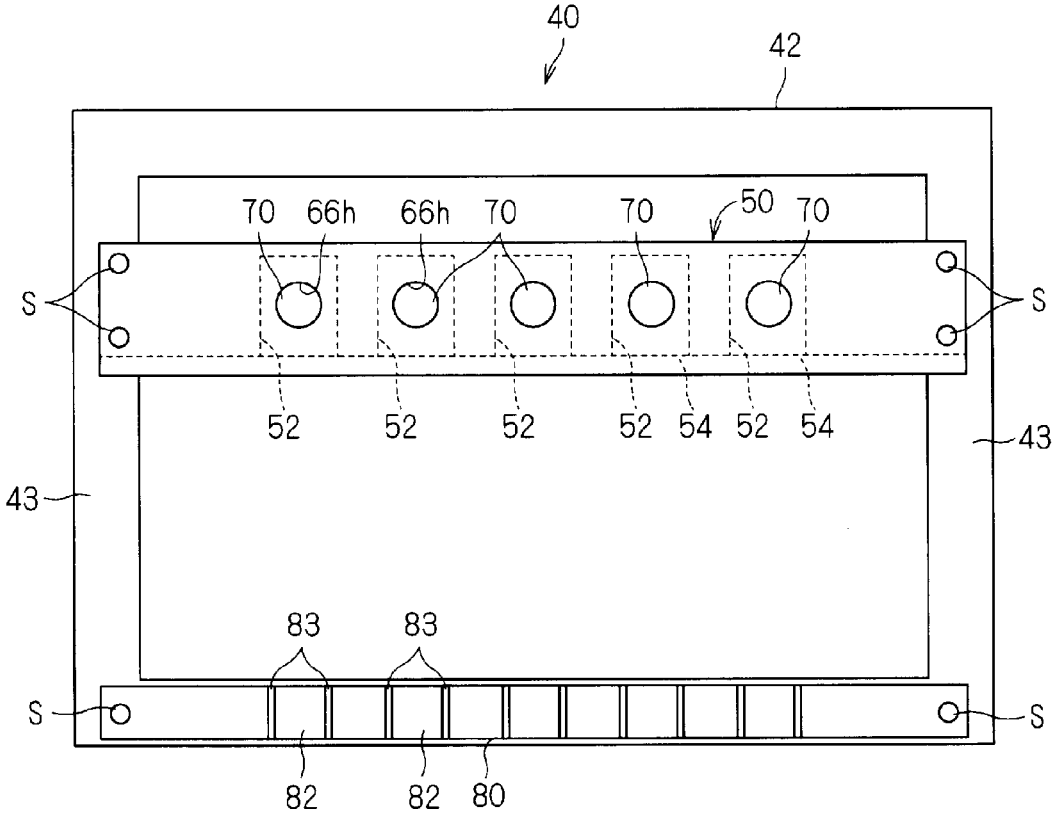
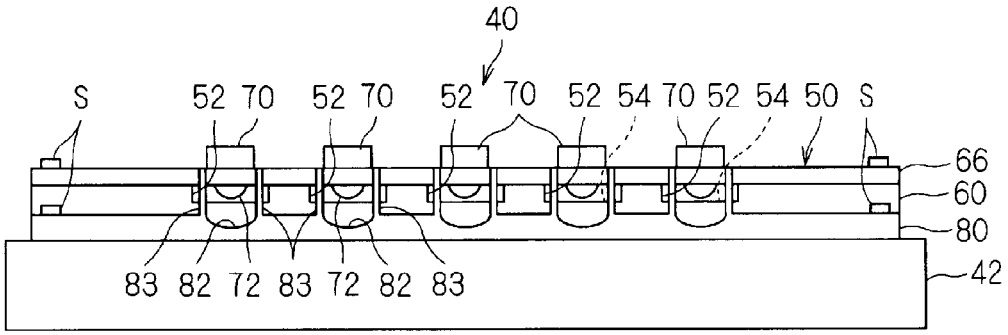
*Figure 4*

*Figure 8*
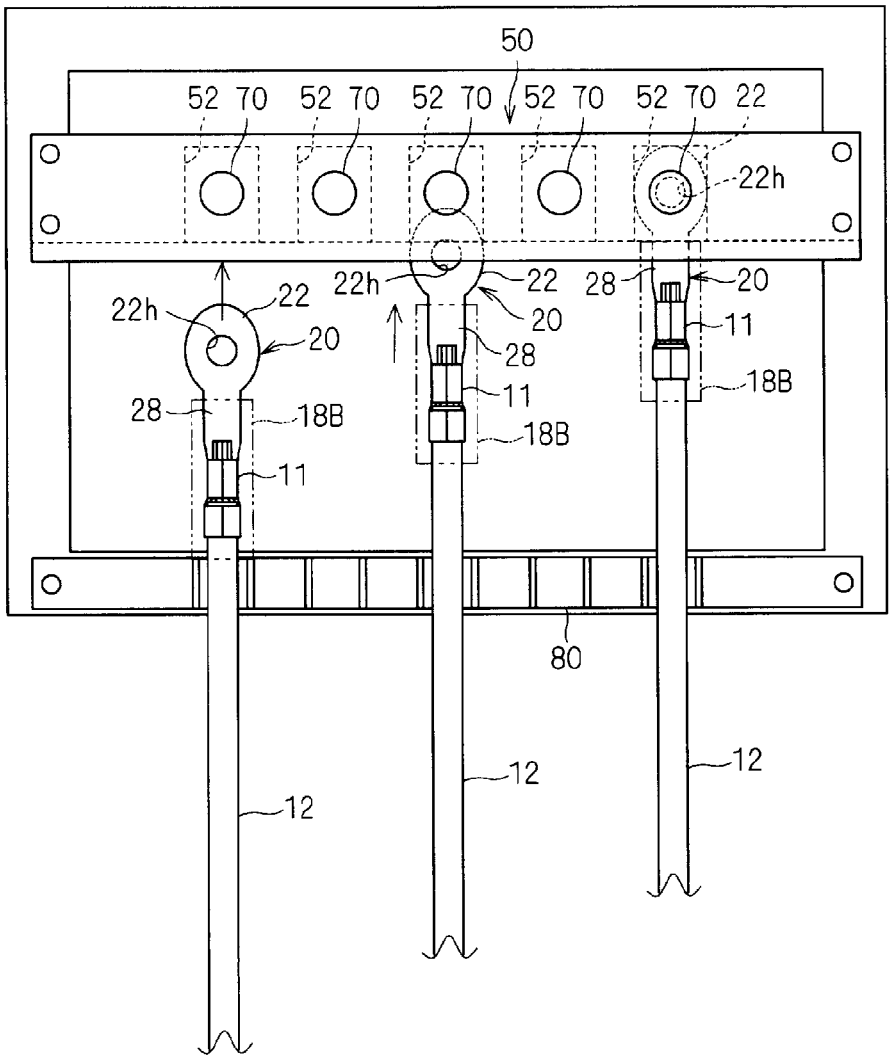
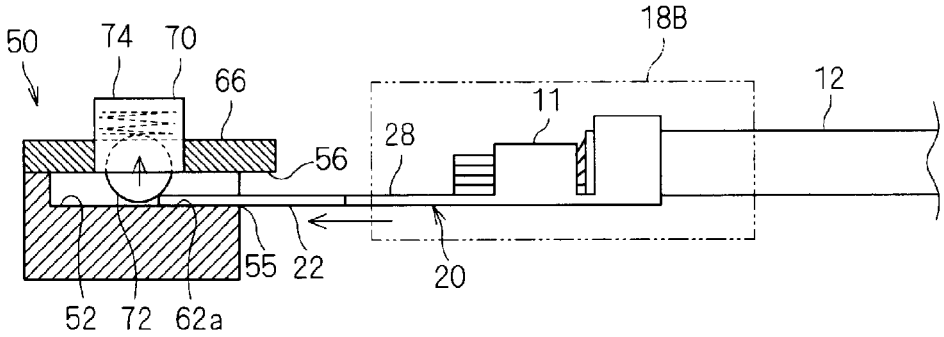
*Figure 9*

*Figure 10*
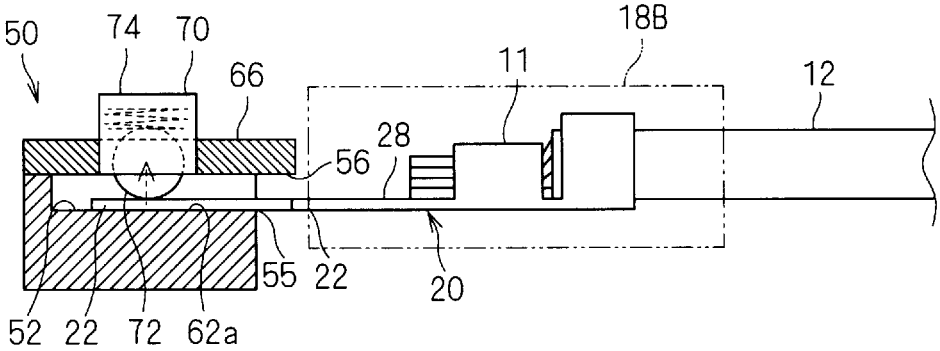
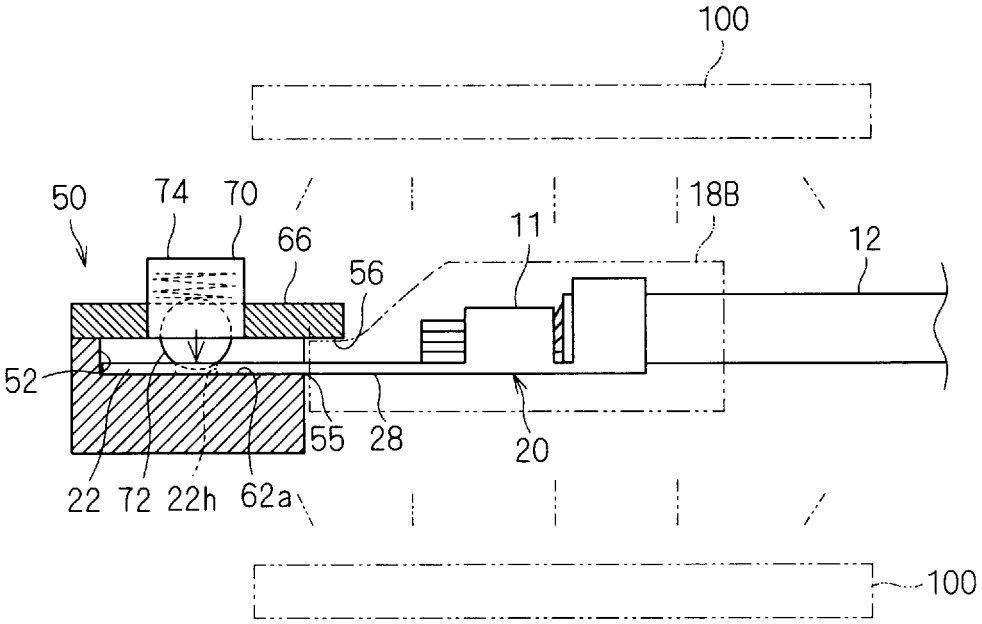
*Figure 11*

TERMINAL FIXING JIG AND METHOD FOR MANUFACTURING ELECTRIC WIRE WITH HEAT-SHRINKABLE TUBE

CROSS REFERENCE TO RELATED APPLICATIONS

This application claims the priority of Japanese patent application JP 2015-057853 filed on Mar. 20, 2015, the entire contents of which are incorporated herein.

TECHNICAL FIELD

The present invention relates to technology for fitting a heat-shrinkable tube onto the connecting portion between an electric wire and a terminal.

BACKGROUND ART

Patent Documents 1 and 2 disclose techniques for, when fitting a heat-shrinkable tube onto the connecting portion between an electric wire and a terminal, suppressing the flow of the hot melt provided inside the heat-shrinkable tube over to the counterpart connecting portion of the terminal.

Patent Document 1 (JP2006-261065A) discloses an earth terminal holder that comprises a base body for receiving an earth terminal whose crimp connecting portion crimped to a wire harness is covered with a hot melt heat-shrinkable tube, a holding means capable of opening and closing relative to the base body to press and hold down the earth terminal received in the base body, and an opening-and-closing means for opening and closing the holding means in the direction in which the earth terminal is inserted. The holding means continuously presses the earth terminal as a result of screwing a screw shaft into a threaded hole formed in the base body to hold down a presser plate, which is the holding means.

Patent Document 2 (JP2013-114936A) discloses a method of attaching a heat-shrinkable tube, comprising the steps of fitting a terminal into a terminal fitting recess in a lower frame, fitting a heat-shrinkable tube that contains hot melt onto a core wire crimp portion of the terminal that extends outward from the lower frame so that one end of the tube abuts against a flood wall of the lower frame, placing an upper frame connected to the lower frame over the terminal fitting recess, and causing a clamp lever provided on a base to clamp the lower frame and the upper frame together.

SUMMARY

According to Patent Document 1, however, fixing a terminal is a cumbersome task because a screw shaft needs to be screwed into a threaded hole in order for the holding means to continuously press and hold down the earth terminal.

According to Patent Document 2, fixing a terminal is also a cumbersome task because the clamp lever needs to be operated to clamp the lower frame and the upper frame together after the upper frame has been placed over the terminal fitting recess.

Therefore, an object of the present design is to facilitate the fixing of a terminal in a manner in which the flow of the water sealant inside the heat-shrinkable tube over to the counterpart connecting portion of the terminal can be suppressed when fitting a heat-shrinkable tube onto the connecting portion between an electric wire and a terminal.

To solve the foregoing problem, a first aspect is directed to a terminal fixing jig for fixing a terminal when a heat-shrinkable tube is fitted onto a connecting portion between an electric wire connecting portion of the terminal and an electric wire, including: a terminal insertion support portion having a terminal insertion recess portion formed therein that is open outward, the terminal insertion recess portion being formed in a shape that allows a plate-shaped counterpart connecting portion of the terminal to be inserted thereinto through the opening, and formed such that at least part of an opening peripheral portion of the terminal insertion recess portion is able to abut against one end of the heat-shrinkable tube fitted onto the connecting portion; and a terminal fitting fixing portion including a fitting portion having a curved surface that gradually protrudes into the terminal insertion recess portion so as to be able to fit in a hole formed in the counterpart connecting portion, and a fitting portion support portion for supporting the fitting portion to enable advance and retraction of the fitting portion while biasing the fitting portion in an advancing direction, wherein the terminal fitting fixing portion is fixed to the terminal insertion support portion such that the fitting portion can come into contact with the counterpart connecting portion to be advanced or retracted depending on the advancement and retraction of the counterpart connecting portion with respect to the terminal insertion recess portion, and the fitting portion can be fitted into the hole of the counterpart connecting portion with the counterpart connecting portion inserted to a rear side of the terminal insertion recess portion.

A second aspect is directed to a terminal fixing jig according to the first aspect, wherein the terminal insertion recess portion is formed by being enclosed by a spaced apart pair of opposite surfaces and a pair of side surfaces that connect the pair of opposite surfaces at their respective sides, the fitting portion is biased from one of the pair of opposite surfaces to the other, and when the counterpart connecting portion is inserted into the terminal insertion recess portion, with one main surface of the counterpart connecting portion opposing one of the pair of opposite surfaces and the other main surface of the counterpart connecting portion opposing the other of the pair of opposite surfaces, the fitting portion presses down the counterpart connecting portion to the other one of the pair of opposite surfaces while fitting into the hole of the counterpart connecting portion.

A third aspect is directed to a terminal fixing jig according to the first or second aspect, wherein the opening peripheral portion of the terminal insertion recess portion includes a flood wall portion formed to be able to abut against one end of the heat-shrinkable tube fitted onto the connecting portion while the flood wall portion is in contact with the terminal on at least one of the two main surfaces of the counterpart connecting portion.

A fourth aspect is directed to a terminal fixing jig according to the first or second aspect, wherein the opening peripheral portion of the terminal insertion recess portion includes a flood wall portion formed to be able to abut against one end of the heat-shrinkable tube fitted onto the connecting portion while the flood wall portion is in contact with the terminal on one of the two main surfaces of the counterpart connecting portion, and a press-down portion for holding down one end of the heat-shrinkable tube toward the terminal from the other of the two main surfaces of the counterpart connecting portion.

A fifth aspect is directed to a terminal fixing jig according to any one of the first to fourth aspects, further including an end positioning member for abutting against the other end of the heat-shrinkable tube from a side opposite to the terminal insertion recess portion.

A sixth aspect is directed to a terminal fixing jig according to any one of the first to fifth aspects, further including an electric wire holding portion for holding the electric wire extending from the terminal, which includes the counterpart connecting portion inserted into the terminal insertion recess portion, at a position away from the terminal insertion support portion.

A seventh aspect is directed to a terminal fixing jig according to any one of the first to sixth aspects, wherein a plurality of the terminal insertion recess portions is formed in parallel in the terminal insertion support portion, and a terminal fitting fixing portion is provided in each of the plurality of terminal insertion recess portions.

An eighth aspect is directed to a method of manufacturing an electric wire with a heat-shrinkable tube using the terminal fitting jig according to any one of the first to seventh aspects, including the steps of: (a) supporting the counterpart connecting portion by inserting the counterpart connecting portion into the terminal insertion recess portion and fitting the fitting portion into the hole of the counterpart connecting portion; (b) abutting one end of the heat-shrinkable tube against at least a part of the opening peripheral portion of the terminal insertion recess portion; and (c) heat-shrinking the heat-shrinkable tube.

According to the first aspect, with the counterpart connecting portion inserted into the terminal insertion recess portion, one end of the heat-shrinkable tube abuts against at least part of the opening peripheral portion of the terminal insertion recess portion. In this way, the water sealant inside the heat-shrinkable tube is stopped by the opening peripheral portion, and is suppressed from flowing to the counterpart connecting portion. Furthermore, as the counterpart connecting portion is inserted into the terminal insertion recess portion, the fitting portion comes into contact with the counterpart connecting portion and is retracted. Then, as the counterpart connecting portion is inserted to the rear of the terminal insertion recess portion to align the hole of the counterpart connecting portion with the fitting portion, the fitting portion advances and fits into the hole of the counterpart connecting portion. In this way, the terminal can be easily fixed.

According to the second aspect, as the fitting portion presses down the counterpart connecting portion to the other surface of the pair of opposite surfaces while fitting into the hole of the counterpart connecting portion, the counterpart connecting portion can be held without rattling.

According to the third aspect, the flood wall portion suppresses the flow of the water sealant to the counterpart connecting portion.

According to the fourth aspect, the flood wall portion can suppress the flow of the water sealant to the counterpart connecting portion. In addition, the press-down portion can suppress the leakage of the water sealant from one end of the heat-shrinkable tube while preventing the displacement thereof.

According to the fifth aspect, the end positioning member can suppress the displacement of the heat-shrinkable tube.

According to the sixth aspect, the electric wire can be held at a position away from the terminal insertion support portion. In this way, the terminal can be held more reliably in a steady position.

According to the seventh aspect, a plurality of terminals can be fixed. This allows for efficient fitting of heat-shrinkable tubes onto a plurality of terminals.

According to the eighth aspect, a terminal can be easily fixed. Moreover, the heat-shrinkable tube can be heat-shrunken while suppressing the flow of the water sealant to the counterpart connecting portion.

BRIEF DESCRIPTION OF DRAWINGS

FIG. 1 is a plan view showing an electric wire with a heat-shrinkable tube.

FIG. 2 is a side view showing the electric wire with a heat-shrinkable tube.

FIG. 3 is a plan view showing a terminal fixing jig.

FIG. 4 is a front-on view showing the terminal fixing jig.

FIG. 8 is an explanatory diagram showing a method of manufacturing an electric wire with a heat-shrinkable tube using the terminal fixing jig.

FIG. 9 is an explanatory diagram showing the method of manufacturing an electric wire with a heat-shrinkable tube using the terminal fixing jig.

FIG. 10 is an explanatory diagram showing the method of manufacturing an electric wire with a heat-shrinkable tube using the terminal fixing jig.

FIG. 11 is an explanatory diagram showing the method of manufacturing an electric wire with a heat-shrinkable tube using the terminal fixing jig.

DESCRIPTION OF EMBODIMENTS

Figure 5:
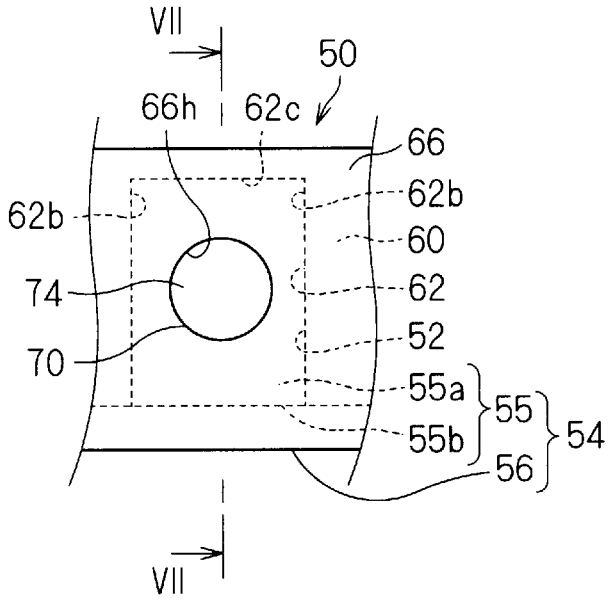
FIG. 5 is a partial plan view showing a terminal insertion support portion and a terminal fitting fixing portion.

The following describes a terminal fixing jig and a method of manufacturing an electric wire with a heat-shrinkable tube using the terminal fixing jig according to certain embodiments.

FIG. 1 is a plan view showing an electric wire 10 with a heat-shrinkable tube that is to be manufactured, and FIG. 2 is a side view showing the electric wire 10 with a heat-shrinkable tube.

The electric wire 10 with a heat-shrinkable tube is provided with an electric wire 12, a terminal 20, and a heat-shrinkable tube 18.

The electric wire 12 is provided with a core wire portion 14 and a sheath portion 16 formed around the core wire portion 14. The core wire portion 14 is formed as a wire made of a conductive material, such as copper, a copper alloy, aluminum, and an aluminum alloy among others. In this case, the core wire portion 14 is formed by twisting together a plurality of element wires. Notwithstanding the above, the core wire portion may also be made of a single wire. The sheath portion 16 is formed by using an extrusion machine, etc., to extrude an insulating resin material around the core wire portion 14. The core wire portion 14 is exposed at the front end of the electric wire 12, forming an exposed core wire portion 14*a* of a predetermined length.

The terminal 20 is a member formed, for example, by stamping a plate material made of copper, a copper alloy, or the like. The surface of the terminal 20 may be plated with tin, for example.

The terminal 20 is provided with a counterpart connecting portion 22, an electric wire connecting portion 24, and a coupling portion 28. The counterpart connecting portion 22 and the electric wire connecting portion 24 are arranged linearly via the coupling portion 28.

The counterpart connecting portion 22 is formed in the shape of a plate. In this case, the counterpart connecting portion 22 is formed in the shape of an elliptic plate. The counterpart connecting portion 22 is formed in the shape of a disc, a rectangle, or the like. The counterpart connecting portion 22 has a hole 22*h* formed therein. A bolt 34 is passed through the hole 22*h*. Although the hole 22*h* has a circular shape, this is not a requirement. In this case, an earth terminal is envisioned as the terminal 20.

The electric wire connecting portion 24 is provided with a core wire crimp portion 25 and a sheath crimp portion 26. The sheath crimp portion 26 is formed on the opposite side of the core wire crimp portion 25 relative to the counterpart connecting portion 22. The core wire crimp portion 25 is comprised of a pair of crimp lugs 25*b* extending from two sides of a bottom portion 25*a*. Additionally, the pair of crimp lugs 25*b* are crimped onto the exposed core wire portion 14*a* with the exposed core wire portion 14*a* set on the bottom portion 25*a*. Moreover, the sheath crimp portion 26 is composed of a pair of crimp lugs 26*b* extending from two sides of a bottom portion 26*a*. The bottom portion 26*a* is continuous with the bottom portion 25*a*. Additionally, the pair of crimp lugs 26*b* are crimped onto the sheath portion 16 with one end of the sheath portion 16 set on the bottom portion 26*a*. This connects the terminal of the electric wire 12 with the electric wire connecting portion 24 of the terminal 20.

It should be noted that the sheath crimp portion 26 may be omitted. Furthermore, the exposed core wire portion may also be connected to the electric wire connecting portion 24 through ultrasonic welding, resistance welding, soldering, etc.

The coupling portion 28 is formed in the shape of a plate that connects the counterpart connecting portion 22 and the bottom portion 25*a* of the electric wire connecting portion 24. The counterpart connecting portion 22 and the coupling portion 28 are coplanar with each other. Although the coupling portion 28 is formed narrower than the counterpart connecting portion 22 in this case, this is not a requirement.

The heat-shrinkable tube 18 is a member that covers the connecting portion 11 between the terminal 20 and the electric wire 12. In this case, the heat-shrinkable tube 18 is formed by heat-shrinking a pre-heat-shrunken heat-shrinkable tube 18B (hereafter, a reference symbol suffixed to the name will be used hereinafter for differentiation, i.e., "18B" for a heat-shrinkable tube that has not been heat-shrunken and "18" for a heat-shrinkable tube that has been heat-shrunken) when it covers the connecting portion 11. It should be noted that the heat-shrinkable tube 18B is obtained by extrusion molding resin into a tubular shape, expanding it into a thicker tube, and then cooling it. The heat-shrinkable tube 18B thus obtained has shape memory properties that enable shrinkage to the original thin tube shape before expansion when subjected to heat.

The heat-shrinkable tube 18 is heat-shrunken to a shape that conforms to the outer shape of the connecting portion 11, adhering as closely as possible to the surface of the connecting portion 11. Additionally, the heat-shrinkable tube 18B has hot melt 19 disposed therein that serves as a water sealant. The hot melt 19 is provided, for example, on the entire inner surface of the heat-shrinkable tube 18B. As the heat-shrinkable tube 18B heat-shrinks, the hot melt 19 softens or melts to fill the gap as much as possible between the surface of the connecting member 11 and the inner surface of the heat-shrinkable tube 18. As the heat-shrinkable tube 18B heat-shrinks, the excess hot melt 19 that did not fit into the gap may run out of the end of the heat-shrinkable tube 18. In this case, the excess hot melt 19 flows from the end of the heat-shrinkable tube 18 located on the sheath portion 16. Moreover, at the end of the heat-shrinkable tube 18 located on the counterpart connecting portion 22, the tube is heat-shrunken using a terminal fixing jig 40, which will be detailed below, so as to suppress the flow of the hot melt 19.

In addition to the hot melt 19, a thermosetting water sealant, moisture-curing water sealant, etc., may also be used as the water sealant. In such a case, it is preferable to pre-coat the connecting portion 11 with the water sealant.

The following describes how the foregoing terminal 20 is connected to the region intended for connection. In particular, a bolt 34 is erected in the region 30 intended for connection (the earth connection region, for example). The periphery of the portion of the region 30 where the bolt 34 is erected is formed using a metal or the like to be a conductive portion. Then, the counterpart connecting portion 22 is disposed on the region 30 by passing the bolt 34 through the hole 22*h*. Subsequently, a nut 36 is screwed onto the bolt 34 to interpose the counterpart connecting portion 22 between the region 30 and the nut 36. This allows the counterpart connecting portion 22 to be fixed in a constant orientation with respect to the region 30 and brings the counterpart connecting portion 22 into contact with the bolt 34 and the nut 36, thus electrically connecting the terminal 20 to the region 30.

As described above, as the terminal 20 is brought into contact with the region 30 and the nut 36 so as to be electrically connected to the foregoing region 30, the electrical connection between the counterpart connecting portion 22 and the region 30 or the nut 36 becomes unstable if the hot melt 19 is attached to the surface of the counterpart connecting portion 22.

The terminal fixing jig 40, which will be described next, is a jig for fixing the terminal 20 while suppressing the flow of the hot melt 19 inside the heat-shrinkable tube 18B to the counterpart connecting portion 22 when the heat-shrinkable tube 18B is heat-shrunken.

FIG. 3 is a plan view showing the terminal fixing jig 40 and FIG. 4 is a front-on view showing the terminal fixing jig 40.

The terminal fixing jig 40 is a jig for fixing terminals 20 when heat-shrinkable tubes 18 are set onto the connecting portions 11 between the electric wire connecting portions 24 of the terminals 20 and the electric wires 12. The terminal fixing jig 40 has a terminal insertion support portion 50, terminal fitting fixing portions 70, and an electric wire holding portion 80. The terminals 20 are fixed by the terminal insertion support portion 50 and a terminal fitting fixing portion 70 while the electric wires 12 are held by the electric wire holding portion 80.

Figure 6:
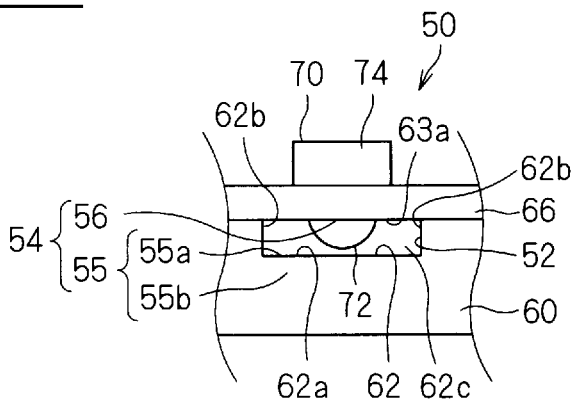
FIG. 6 is a partial front-on view showing the terminal insertion support portion and the terminal fitting fixing portion.
Figure 7:
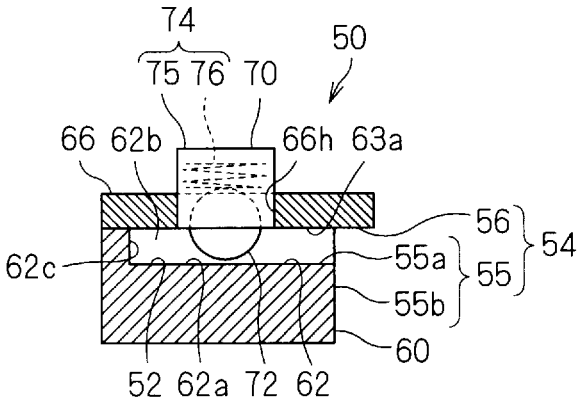
FIG. 7 is a cross-sectional view taken along line VII-VII of FIG. 5.

FIG. 5 is a partial plan view of the terminal insertion support portion 50 and a terminal fitting fixing portion 70, FIG. 6 is a partial front-on view of the terminal insertion support portion 50 and the terminal fitting fixing portion 70, and FIG. 7 is a cross-sectional view taken along line VII-VII of FIG. 5.

The terminal insertion support portion 50 is fixed to a jig frame 42. The jig frame 42 is made of a metal, etc., and formed in a rectangular shape.

The terminal insertion support portion 50 is formed in an elongated shape fixed to the jig frame 42 with screws S, etc., to span a pair of side portions 43 of the jig frame 42.

The terminal insertion support portion 50 has terminal insertion recess portions 52 formed therein that are open outward. The terminal insertion recess portions 52 are open toward one side of the side portions 43 and formed in such a shape that allows the counterpart connecting portions 22 of terminals 20 to be inserted through the opening thereof. Furthermore, at least a portion of each peripheral portion 54 of the openings of the terminal insertion recess portions 52 is formed to be able to abut against one end of each of the heat-shrinkable tubes 18 fitted onto the connecting portions 11.

More specifically, the terminal insertion support portion 50 is provided with a base portion 60 and a lid portion 66. The base portion 60 and the lid portion 66 are preferably made of a material to which the hot melt 19 does not easily adhere. For example, they are preferably made of a resin, such as Teflon®. Alternatively, only the portions of the base portion 60 and the lid portion 66 that come into contact with the heat-shrinkable tubes 18B, that is, the peripheral portions 54 of the openings of the terminal insertion recess portions 52, which will be described in detail later, may be made of a resin, such as Teflon®. Moreover, it is preferable that the base portion 60 and the lid portion 66 are entirely made of a material that can withstand temperatures that induce heat-shrinking of the heat-shrinkable tubes 18. Teflon® resin satisfies this requirement.

The base portion 60 is formed in a long and narrow rectangular shape that can be mounted to span the pair of side portions 43. The upper surface of the base portion 60 has recess portions 62 formed therein. Each recess portion 62 is enclosed on three sides by a bottom surface 62*a* and a pair of side surfaces 62*b* to form a groove that has a rectangular cross section. One side of the recess portion 62 is closed by a rear surface 62*c* while the opposite side is open to the outside. Additionally, the side of the recess portion 62 opposite the bottom surface 62*a* is open.

The depth dimension of the recess portion 62 is the same as or greater (slightly larger) than the thickness dimension of the counterpart connecting portion 22. The width dimension of the recess portion 62 is the same as or greater (slightly larger) than the maximum width dimension of the counterpart connecting portion 22. It is preferable that the width of the recess portion 62 be set to a width that does not allow the counterpart connecting portion 22 to rattle in the recess portion 62 in the width direction. The length from the opening to the rear surface 62*c* of the recess portion 62 is set to be able to receive the counterpart connecting portion 22. It should be noted that the rear surface 62*c* may be omitted so that the recess portion 62 is open at this position as well.

In this case, a plurality of (i.e., five) of recess portions 62 are formed at intervals in the base portion 60 along its extension direction. The top surface of the base portion 60 is formed on the same plane except for positions where the foregoing recess portions 62 are formed.

The lid portion 66 is formed in a long and narrow rectangular shape that can be mounted to span the pair of side portions 43. The length dimension of the lid portion 66 is set to be the same as the length dimension of the base portion 60. In addition, the width dimension of the lid portion 66 (the dimension along which the recess portions 62 extend) is larger than the width dimension of the base portion 60 along the same direction. The bottom surface of the lid portion 66 is formed as a flat surface.

The lid portion 66 is set on the top surface of the base portion 60 with one side thereof aligned with one side of the base portion 60 (the side opposite to the side of the recess portions 62 where openings are located). In this way, the upper openings of the foregoing recess portions 62 are closed by the lid portion 66. The portions of the bottom surface of the lid portion 66 that cover the upward openings of the recess portions 62 constitute ceiling surfaces 63*a*. It should be noted that the lid portion 66 and the base portion 60 are fixed to the jig frame 42 with the screws S, etc., with the lid portion 66 set on the base portion 60.

In this way, the terminal insertion recess portions 52, which open outward, are formed by covering the upward openings of the recess portions 62 formed in the base portion 60 with the lid portion 66. In this case, as a plurality of recess portions 62 are formed in parallel, a plurality of terminal insertion recess portions 52 are formed in the terminal insertion support portion 50.

Focusing on the terminal insertion recess portion 52, the bottom surface 62*a* and the ceiling surface 63*a* constitute a spaced-apart pair of opposite surfaces and the pair of side surfaces 62*b* connect the bottom surface 62*a* and the ceiling surface 63*a* (i.e., a pair of opposite surfaces) at their respective sides. The terminal insertion recess portion 52 is formed as a closed-end square recess portion surrounded by a pair of the bottom surface 62*a* and the ceiling surface 63*a* (i.e., a pair of opposite surfaces) and a pair of side surfaces.

A counterpart connecting portion 22 is inserted into such a terminal insertion recess portion 52 as follows. Specifically, the counterpart connecting portion 22 is inserted into the terminal insertion recess portion 52 so that one of the main surfaces of the counterpart connecting portion 22 (the top surface, on which an electric wire 12 is disposed) opposes the ceiling surface 63*a*, which is one of the pair of opposite surfaces, and the other main surface of the counterpart connecting portion 22 (the lower surface) opposes the bottom surface 62*a*, which is the other one of the pair of opposite surfaces.

It should be noted that the counterpart connecting portion 22 may be inserted into the terminal insertion recess portion 52 so that that the other main surface of the counterpart connecting portion 22 (the surface on which an electric wire 12 is not disposed) opposes the ceiling surface 63*a* of the pair of opposite surfaces, and that one main surface of the counterpart connecting portion 22 opposes the bottom surface 62*a* of the pair of opposite surfaces. This is because the hot melt can be suppressed from flowing to the counterpart connecting portion 22 by a flood wall portion 55 and press-down portion 56.

At least part of the peripheral portion 54 of the opening of the terminal insertion recess portion 52 is formed to be able to abut against one end of the heat-shrinkable tube 18B fitted onto the connecting portion 11 when the counterpart connecting portion 22 is fully inserted in the terminal insertion recess portion 52.

In this case, the peripheral portion 54 of the opening of the terminal insertion recess portion 52 includes the flood wall portion 55 and the press-down portion 56.

More specifically, a part of the peripheral portion 54 of the opening of the terminal insertion recess portion 52 that is formed by the base portion 60 constitutes the flood wall portion 55. That is, of the peripheral portion of the side opening of the terminal insertion recess portion 52, a part 55*a* of the lower surface 62*a* constitutes part of the flood wall portion 55 and comes into contact with at least one of the two main surfaces (the lower surface) of the counterpart connecting portion 22. In this case, the part 55*a* of the flood wall portion 55 formed on the lower surface 62*a* comes into contact with the bottom surface of the coupling portion 28. Furthermore, of the peripheral portion of the side opening of the terminal insertion recess portion 52, an outward facing part 55*b* of the lower surface 62*a* constitutes part of the flood wall portion 55 and comes into contact with one end of the heat-shrinkable tube 18B fitted onto the connecting portion 11 from the counterpart connecting portion 22 side.

In this way, by abutting the flood wall portion 55 against one end of the heat-shrinkable tube 18B while the flood wall portion 55 is in contact with the bottom surface of the coupling portion 28 of the terminal 20, the hot melt 19 that would otherwise flow out of the end of the heat-shrinkable tube 18B can be prevented from running into the counterpart connecting portion 22.

Moreover, the part of the peripheral portion 54 of the opening of the terminal insertion recess portion 52 formed by the lid portion 66 constitutes the press-down portion 56. That is, as the lid portion 66 protrudes further outward past the side opening of the recess portion 62, and this protrusion constitutes the press-down portion 56. With the counterpart connecting portion 22 fully inserted into the terminal insertion recess portion 52, one end of the heat-shrinkable tube 18B is brought into contact with the flood wall portion 55 as described above. In this way, the press-down portion 56 is placed over the end of the heat-shrinkable tube 18B from above the counterpart connecting portion 22, thus pressing the end of the heat-shrinkable tube 18B toward the terminal 20 (more particularly, the upper surface of the coupling portion 28). In other words, this end of the heat-shrinkable tube 18B is pinched and held between the upper surface of the coupling portion 28 of the terminal 20 and the press-down portion 56.

However, the press-down portion 56 does not necessarily have to be formed as described above. Rather, the entire opening on the end of the heat-shrinkable tube 18B may abut against the peripheral portion of the opening of the terminal insertion recess portion 52.

The terminal fitting fixing portion 70 uses the hole 22*h* of the counterpart connecting portion 22 to fix it upon its insertion into the terminal insertion recess portion 52.

The terminal fitting fixing portion 70 is provided with a fitting portion 72 and a fitting portion support portion 74.

The fitting portion 72 has a curved surface that gradually protrudes into the terminal insertion recess portion 52 so as to be able to fit into the hole 22*h* formed in the counterpart connecting portion 22. In this case, the fitting portion 72 is shaped as a sphere that forms a curved surface gradually protruding into the terminal insertion recess portion 52. Preferably, the diameter dimension of the fitting portion 72 is larger than the outer diameter of the hole 22*h*. The fitting portion 72 does not have to be spherical. For example, only the top end of the fitting portion may be formed as a half-sphere or a cone that gradually protrudes.

The fitting portion support portion 74 is configured to support the foregoing fitting portion 72 to enable its advance and retraction while biasing the fitting portion 72 in the advancing direction. More particularly, the fitting portion support portion 74 has a cylindrical portion 75 and a coil spring 76 that serves as a biasing portion. The cylindrical portion 75 is formed as a closed-end cylinder, and the fitting portion 72 is held in the cylindrical portion 75 while partially protruding from an opening in the cylindrical portion 75. Preferably, the opening of the cylindrical portion 75 is formed to narrow to become smaller than the diameter dimension of the fitting portion 72 so that the spherical fitting portion 72 can be held by the cylindrical portion 75 in a manner that allows its advance and retraction while preventing it from slipping out of the cylindrical portion 75. Moreover, the coil spring 76 is disposed in the cylindrical portion 75 where it is compressed between the bottom portion and the fitting portion 72. The fitting portion 72 is biased in the advancing direction by this coil spring 76. For example, a ball plunger can be used as the terminal fitting fixing portion 70.

The foregoing terminal fitting fixing portion 70 is fixed to the lid portion 66 in the following manner.

In other words, a fixing hole 66*h* is formed at each position of the lid portion 66 where it covers the recess portions 62. The fixing hole 66*h* is located where the hole 22*h* is to be disposed once the counterpart connecting portion 22 is fully inserted into the terminal insertion recess portion 52. The cylindrical portion 75 is fitted and fixed in the fixing hole 66*h* so as to allow the fitting portion 72 to protrude into the terminal insertion recess portion 52. In this case, one terminal fitting fixing portion 70 is provided for each of the plurality of terminal insertion recess portions 52. In the fixed state, the fitting portion 72 comes into contact with the counterpart connecting portion 22 and is advanced or retracted depending on the advance and retraction of the counterpart connecting portion 22 with respect to the terminal insertion recess portion 52, and the fitting portion 72 is fitted into the hole 22*h* of the counterpart connecting portion 22 once the counterpart connecting portion 22 is fully inserted to the rear side of the terminal insertion recess portion 52. Furthermore, with the fitting portion 72 fitted in the hole 22*h*, the fitting portion 72 is in contact with the peripheral portion of the hole 22*h* and presses the counterpart connecting portion 22 against the bottom surface 62*a*, which is the other surface of the pair of opposite surfaces. A detailed description will be provided below.

The electric wire holding portion 80 is configured to be able to hold electric wires 12 extending from the terminals 20, which include counterpart connecting portions 22 inserted in the terminal insertion recess portions 52, at a position away from the terminal insertion support portion 50.

More specifically, the electric wire holding portion 80 is fixed to the frame portion of one end of the pair of the side portions of the jig frame 42. The electric wire holding portion 80 is formed as an elongated member having the same length dimension as that of the terminal insertion support portion 50. Electric wire holding grooves 82 are formed in the upper portion of the electric wire holding portion 80 where they correspond to the respective terminal insertion recess portions 52. In this case, pairs of wire supporting protrusions 83 are provided on the wire holding portion 80 and a wire holding groove 82 is formed by concaving the portion between each pair of wire supporting protrusions 83 in the shape of an arc. The width dimension of the wire holding groove 82 is set to the same as or greater (slightly larger) than the diameter dimension of the electric wire 12. In addition, the wire holding groove 82 is open upward. Also, by inserting the electric wire 12 into the wire holding groove 82 through the upward opening of the wire holding groove 82, the electric wire 12 is held in the widthwise direction at a fixed position.

However, the structure for holding the electric wire 12 is not limited to the above. It will also suffice if the electric wire holding portion simply has grooves formed therein. Alternatively, the electric wire holding portion may also support electric wires by pinching them.

Manufacturing Method

The following describes a method of manufacturing heat-shrinkable tubes 10 using the terminal fixing jig 40 described above.

FIG. 8 shows the process of inserting a counterpart connecting portion 22 into a terminal insertion recess portion 52 sequentially from left to right.

First, as shown on the left side of FIG. 8, a terminal-attached electric wire that has a heat-shrinkable tube 18B fitted onto its connecting portion 11 is prepared, and the counterpart connecting portion 22 is to be inserted into a terminal insertion recess portion 52.

As shown in the center of FIG. 8 and in FIG. 9, when the counterpart connecting portion 22 is inserted halfway into the terminal insertion recess portion 52, the leading end of the counterpart connecting portion 22 comes into contact with the fitting portion 72. Then, as shown in FIG. 10, the fitting portion 72 retracts as it is pushed back by the counterpart connecting portion 22. This allows the counterpart connecting portion 22 to be inserted further into the terminal insertion recess portion 52.

As shown on the right side of FIG. 8 and in FIG. 11, once the counterpart connecting portion 22 has been inserted into the terminal insertion recess portion 52 until the hole 22*h* of the counterpart connecting portion 22 reaches the fitting portion 72, the fitting portion 72 advances under the biasing force of the coil spring 76. At this moment, the fitting portion 72 comes into contact with the peripheral portion of the hole 22*h* before the fitting portion 72 comes into contact with the bottom surface 62*a*. This causes the fitting portion 72 to hold down the counterpart connecting portion 22 to the bottom surface 62*a*. In this state, the other main surface of the counterpart connecting portion 22 and the surface of the coupling portion 28 on the same side are held down to, and are in surface contact with, the bottom surface 62*a*. It should be noted that the fitting portion 72 may also fit in the hole 22*h* as well as be in contact with the bottom surface 62*a*.

Moreover, the end of the heat-shrinkable tube 18B located on the counterpart connecting portion 22 and on the base portion 60, is inserted into the terminal insertion support portion 50 until it comes into contact with the flood wall portion 55. At this moment, the end of the heat-shrinkable tube 18B located on the counterpart connecting portion 22 and on the lid portion 66, is disposed inside of the press-down portion 56 so that the press-down portion 56 presses down the end of the heat-shrinkable tube 18B toward the terminal 20.

It should be noted that, when the counterpart connecting portion 22 is inserted into the terminal insertion recess portion 52, the electric wire 12 can be fitted into the electric wire holding groove 82 and moved along its longitudinal direction, thus facilitating the insertion of the counterpart connecting portion 22.

In this state, the heat-shrinkable tube 18B is heated by a heating unit 100 to initiate heat shrinkage. When being heat-shrunk, the heat-shrinkable tube 18B is heat-shrunk to conform to the outer shape of the connecting portion 11. The hot melt 19 inside the heat-shrinkable tube 18B softens or melts to fill the gap between the connecting member 11 and the heat-shrinkable tube 18 while the excess portion attempts to flow out of the end of the heat-shrinkable tube 18.

The end of the heat-shrinkable tube 18 located on the terminal insertion support portion 50 is partially in contact with the flood wall portion 55. Moreover, the flood wall portion 55 is also in contact with the other main side of the coupling portion 28. Accordingly, at this portion, the excess hot melt 19 is not likely to run over to the counterpart connecting portion 22.

Further, as part of the other portion of the end of the heat-shrinkable tube 18 located on the terminal insertion support portion 50 is pressed down toward the coupling portion 28 of the terminal 20 by the press-down portion 56, the gap between the other portion of the end of the heat-shrinkable tube 18 and the terminal 20 is closed. Accordingly, the excess hot melt 19 is not likely to run to the counterpart connecting portion 22 at that portion either.

Accordingly, this suppresses the flow of the excess hot melt 19 to the counterpart connecting portion 22. It should be noted that the excess hot melt 19 that flows out of the end of the heat-shrinkable tube 18 that is on the electric wire 12 does not have any particular functional effect.

It should be noted that to perform the foregoing heating, the jig frame 42 may be manually held and moved to the vicinity of the heating unit 100, or the heating unit 100 may alternatively be moved to the vicinity of the heat-shrinkable tube 18B supported by the jig frame 42.

Effects, Etc.

According to the terminal fixing jig 40 tube thus constructed and the method of manufacturing an electric wire 10 with a heat-shrinkable, with the counterpart connecting portion 22 inserted into the terminal insertion recess portion 52, one end of the heat-shrinkable tube 18B abuts against the flood wall portion 55, which constitutes at least part of the opening peripheral portion 54 of the terminal insertion recess portion 52. In this way, the flood wall portion 55 can stop the hot melt 19 in the heat-shrinkable tube 18 and suppress the flow of the hot melt 55 to the earth portion 22. Furthermore, as the counterpart connecting portion 22 is inserted into the terminal insertion recess portion 52, the fitting portion 72 comes into contact with the counterpart connecting portion 22 and is retracted. Then, as the counterpart connecting portion 22 is inserted to the rear of the terminal insertion recess portion 52 to align the hole 22*h* of the counterpart connecting portion 22 with the fitting portion 72, the fitting portion 72 advances and fits into the hole 22*h*. In this way, the terminal 20 can easily be fixed through the simple operation of inserting the counterpart connecting portion 22 into the terminal insertion recess portion 52.

Furthermore, as the fitting portion 72 presses down the counterpart connecting portion 22 to the bottom surface 62*a* while the fitting portion 72 fits into the hole 22*h* of the counterpart connecting portion 22, the counterpart connecting portion 22 can be held without rattling. However, it is not a requirement for the fitting portion 72 to hold down the counterpart connecting portion 22 to the bottom surface 62*a*. That is because, once the fitting portion 72 fits into the hole 22*h*, the terminal 20 can be positioned to a certain extent.

Moreover, as the flood wall portion 55 abuts against one end of the heat-shrinkable tube 18B while the flood wall portion 55 is in contact with the downward surface of the coupling portion 28, the flood wall portion 55 can more reliably suppress the flow of the hot melt 19 to the counterpart connecting portion 22 side. However, even in the case where the peripheral portion of the opening of the terminal insertion recess portion 52 does not come into contact with either of the main surfaces of the terminal 20, as long as it abuts against the end of heat-shrinkable tube 18B, the flow of the hot melt 19 to the counterpart connecting portion 22 can be suppressed to a certain degree. Therefore, it is not a requirement for the peripheral portion of the opening of the terminal insertion recess portions 52 to come into contact with either of the main surfaces of the terminals 20.

Further, as part of one end of the heat-shrinkable tube 18 is pressed down toward the coupling portion 28 of the terminal 20 by the press-down portion 56, the displacement of the heat-shrinkable tube 18B can be suppressed and the gap between that end and the terminal 20 is closed to suppress the leakage of the hot melt 19.

In addition, as the electric wire 12 is held at a position away from the terminal insertion support portion 50, the terminal 20 can be more reliably held in a steady position.

Moreover, as a plurality of terminal insertion recess portions 52 are formed in parallel, a plurality of heat-shrinkable tubes 18B can be heat-shrunken at once with the counterpart connecting portions 22 held in the respective terminal insertion recess portions 52, thus allowing for efficient fitting of the heat-shrinkable tubes 18 onto the terminals 20.

Variations

Figure 12:
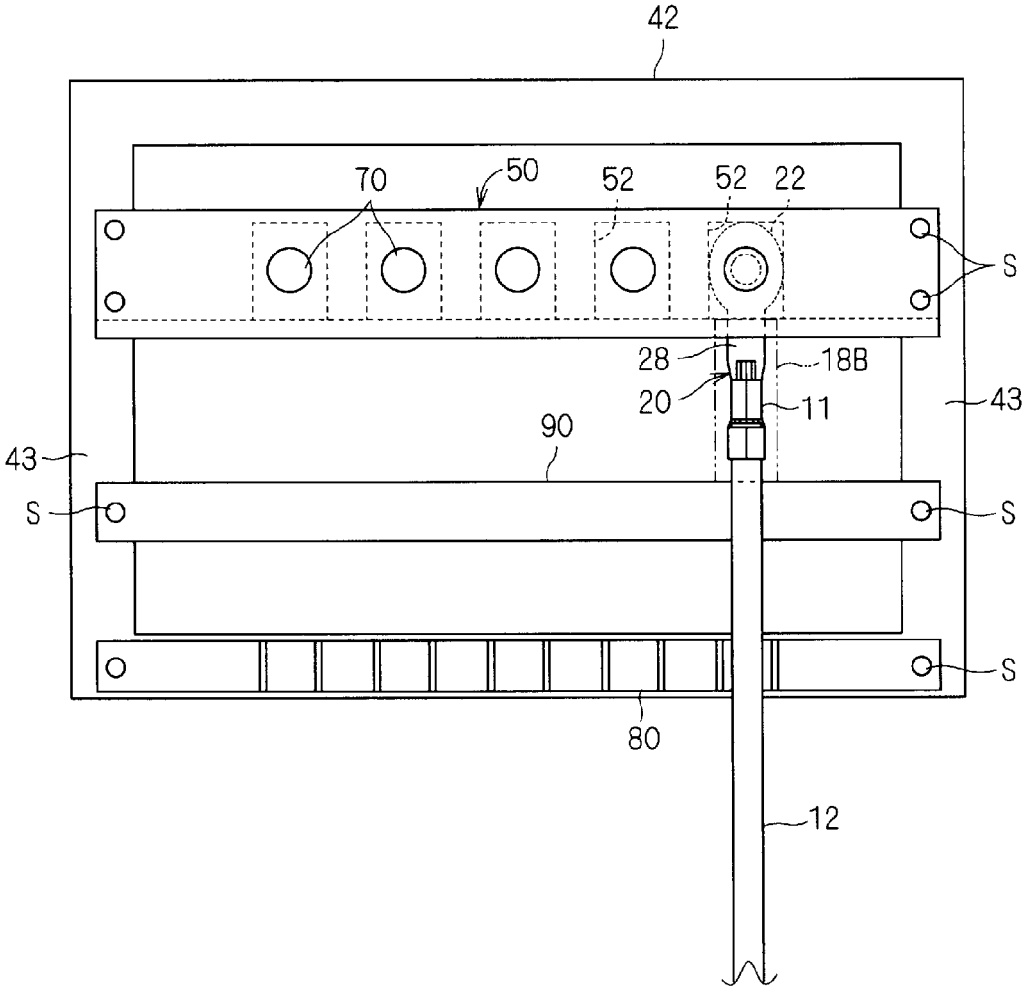
FIG. 12 is a plan view showing a variant of the terminal fixing jig.

It should be noted that, in the foregoing embodiment, as in the variant shown in FIG. 12, an end positioning member 90 may be provided that abuts against the other end of the heat-shrinkable tube 18B from the side opposite to the terminal insertion recess portion 52. In this case, the end positioning member 90 is formed in the shape of a rectangular plate having the same length dimension as that of the terminal insertion support portion 50. The end positioning member 90 is fixed with screws S, etc., to span the pair of side portions 43 of the jig frame 42 at a position separated from the terminal insertion support portion 50 by a distance corresponding to the length of a heat-shrinkable tube 18B. The end positioning member 90 abuts against the other end of the heat-shrinkable tube 18B from below the electric wire 12 so as to suppress the movement of the heat-shrinkable tube 18B away from the terminal insertion support portion 50.

This can further ensure that the heat-shrinkable tubes 18B are heat-shrunken at a fixed position.

It should be noted that the elements described with respect to the foregoing embodiments and variants may be combined if necessary as long as they are compatible with each other.

Having described the present design in detail, the foregoing description is illustrative in all aspects and the present invention is not limited thereto. It is understood that countless variations not illustrated herein are conceivable without departing from the scope of the present invention.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMERALS

10 Electric wire with a heat-shrinkable tube
11 Connecting portion
12 Electric wire
18 Heat-shrinkable tube (after heat shrinkage)
18B Heat-shrinkable tube (before heat shrinkage)
19 Hot melt
20 Terminal
22 Counterpart connecting portion
22*h* Hole
24 Electric wire connecting portion
28 Coupling portion
40 Terminal fixing jig
50 Terminal insertion support portion
52 Terminal insertion recess portion
55 Flood wall portion
56 Press-down portion
62*a* Bottom surface
62*b* Side surface
63*a* Ceiling surface
70 Terminal fitting fixing portion
72 Fitting portion
76 Coil spring
80 Electric wire holding portion
82 Electric wire holding groove
90 End positioning member

The invention claimed is:

1. A terminal fixing jig for fixing a terminal when a heat-shrinkable tube is fitted onto a connecting portion between an electric wire connecting portion of the terminal and an electric wire, comprising:

a terminal insertion support portion having a terminal insertion recess portion formed therein that is open outward, the terminal insertion recess portion being formed in a shape that allows a plate-shaped counterpart connecting portion of the terminal to be inserted thereinto through the opening, and formed such that at least part of an opening peripheral portion of the terminal insertion recess portion is able to abut against one end of the heat-shrinkable tube fitted onto the connecting portion; and a terminal fitting fixing portion including a fitting portion having a curved surface that gradually protrudes into the terminal insertion recess portion so as to be able to fit in a hole formed in the counterpart connecting portion, and a fitting portion support portion for supporting the fitting portion to enable advance and retraction of the fitting portion while biasing the fitting portion in an advancing direction, wherein the terminal fitting fixing portion is fixed to the terminal insertion support portion such that the fitting portion can come into contact with the counterpart connecting portion to be advanced or retracted depending on the advancement and retraction of the counterpart connecting portion with respect to the terminal insertion recess portion, and the fitting portion can be fitted into the hole of the counterpart connecting portion with the counterpart connecting portion inserted to a rear side of the terminal insertion recess portion.

2. A terminal fixing jig according to claim 1, wherein the terminal insertion recess portion is formed by being enclosed by a spaced apart pair of opposite surfaces and a pair of side surfaces that connect the pair of opposite surfaces at their respective sides, the fitting portion is biased from one of the pair of opposite surfaces to the other, and when the counterpart connecting portion is inserted into the terminal insertion recess portion, with one main surface of the counterpart connecting portion opposing one of the pair of opposite surfaces and the other main surface of the counterpart connecting portion opposing the other of the pair of opposite surfaces, the fitting portion presses down the counterpart connecting portion to the other one of the pair of opposite surfaces while fitting into the hole of the counterpart connecting portion.

3. A terminal fixing jig according to claim 1, wherein the opening peripheral portion of the terminal insertion recess portion includes a flood wall portion formed to be able to abut against one end of the heat-shrinkable tube fitted onto the connecting portion while the flood wall portion is in contact with the terminal on at least one of the two main surfaces of the counterpart connecting portion.

4. A terminal fixing jig according to claim 1, wherein the opening peripheral portion of the terminal insertion recess portion includes a flood wall portion formed to be able to abut against one end of the heat-shrinkable tube fitted onto the connecting portion while the flood wall portion is in contact with the terminal on one of the two main surfaces of the counterpart connecting portion, and a press-down portion for holding down one end of the heat-shrinkable tube toward the terminal from the other of the two main surfaces of the counterpart connecting portion.

5. A terminal fixing jig according to claim 1, further comprising an end positioning member for abutting against the other end of the heat-shrinkable tube from a side opposite to the terminal insertion recess portion.

6. A terminal fixing jig according to claim 1, further comprising an electric wire holding portion for holding the electric wire extending from the terminal, which includes the counterpart connecting portion inserted into the terminal insertion recess portion, at a position away from the terminal insertion support portion.

7. A terminal fixing jig according to claim 1, wherein a plurality of the terminal insertion recess portions are formed in parallel in the terminal insertion support portion, and a terminal fitting fixing portion is provided in each of the plurality of terminal insertion recess portions.

8. A method of manufacturing an electric wire with a heat-shrinkable tube using the terminal fitting jig according to claim 1, comprising the steps of:

(a) supporting the counterpart connecting portion by inserting the counterpart connecting portion into the terminal insertion recess portion and fitting the fitting portion into the hole of the counterpart connecting portion;

(b) abutting one end of the heat-shrinkable tube against at least a part of the opening peripheral portion of the terminal insertion recess portion; and (c) heat-shrinking the heat-shrinkable tube.

* * * * *